United States Patent [19]

Zerbel

[11] 4,423,310

[45] Dec. 27, 1983

[54] ELECTRICAL STEAM GENERATOR HAVING ADJUSTABLE ELECTRODES FOR AN AIR HUMIDIFIER

[75] Inventor: Allen J. Zerbel, Madison, Wis.

[73] Assignee: Wehr Corporation, Milwaukee, Wis.

[21] Appl. No.: 251,159

[22] Filed: Apr. 6, 1981

[51] Int. Cl.[3] ..... H05B 3/60; F22B 1/30

[52] U.S. Cl. ..... 219/285; 219/275; 219/288; 219/289; 219/293; 338/83; 338/86

[58] Field of Search ..... 219/284–295, 219/271–276; 338/80–86; 261/142, 141

[56] References Cited

U.S. PATENT DOCUMENTS

| | | | |
|---|---|---|---|
| 535,267 | 3/1895 | Wagner et al. | 219/291 X |
| 1,217,514 | 2/1917 | Simmon | 338/86 X |
| 1,543,514 | 6/1925 | Otis | 219/288 |
| 1,641,532 | 9/1927 | Cronin | 219/288 X |
| 1,739,030 | 12/1929 | Henry | 219/289 X |
| 2,556,656 | 6/1951 | Lohman | 219/286 |
| 3,761,679 | 9/1973 | Dall | 219/288 |
| 3,854,193 | 6/1971 | Badertscher | 219/289 X |
| 4,092,519 | 5/1978 | Eaton-Williams | 219/284 |

FOREIGN PATENT DOCUMENTS

| | | | |
|---|---|---|---|
| 167791 | 8/1950 | Austria | 219/288 |
| 612121 | 4/1935 | Fed. Rep. of Germany | 338/86 |
| 122148 | 5/1971 | Norway | 219/293 |
| 242118 | 9/1946 | Switzerland | 219/285 |
| 475571 | 12/1937 | United Kingdom | 219/291 |
| 207559 | 3/1968 | U.S.S.R. | 219/288 |

*Primary Examiner*—A. Bartis

[57] ABSTRACT

The steam generator includes a cylindrical tank, a plurality of circumferentially-spaced electrical terminals extending through the tank top wall. To afford the capability of adjusting the horizontal distance between adjacent electrodes while maintaining the sides parallel and uniformly spaced, the underside of the tank top wall is provided with a radially extending row of radially-spaced bosses in conjunction with each terminal and each boss includes an aperture radially aligned with the corresponding terminal. The upper end of each electrode includes a radially-extending row of apertures which are adapted to receive the inner end of a terminal and are spaced so that, when a terminal is positioned in one of the electrode apertures, at least one other is in registration with a tank boss aperture to receive a metal screw or the like for anchoring the electrode on the tank. The electrodes each include a pair of vertical, generally flat, elongated perforated metal side members joined together in angular relationship along an inner edge to form a V-shaped cross-section and have an upper portion with vertical outer edges extending generally parallel to the tank side wall and a thicker lower portion having outer edges which extend at an incline downwardly and radially inwardly from the outer edges of the upper portion and terminate at the bottom in a generally horizontally extending edge.

9 Claims, 5 Drawing Figures

ELECTRICAL STEAM GENERATOR HAVING ADJUSTABLE ELECTRODES FOR AN AIR HUMIDIFIER

BACKGROUND OF THE INVENTION

This invention relates to air humidifiers employing an electrically operated steam generator and, more particularly, to the water tank and electrodes for such steam generators.

Air humidifiers including an electrical steam generator for producing a stream of steam which is dispersed into the air distribution system for a building are well known. The steam generator includes a water tank which is partially filled with water and a plurality of electrodes immersed in the water. Electrical voltage is induced on the electrodes, current passing through the water causes it to boil, and a stream of steam is discharged through an opening in the top of the tank. Current flow between the electrodes is directly porportional to the surface area of the electrodes covered by the water. A control system controls the operation of a valve which admits water into the tank to maintain the water at a level necessary to produce steam at a rate required to obtain the desired humidification. The control system also periodically opens a drain valve for the purpose of removing contaminants from the tank.

Tap water is normally used and the water hardness varies considerably from locale to locale. Minerals in the water, such as calcium carbonate, tend to deposit on the surface of the electrodes. These deposits act as an insulator and reduce the effectiveness of the electrodes. The hardness of the water affects its conductivity. Thus, the water level in the tank required to produce a predetermined amount of steam at a given voltage varies depending on the extent of mineral deposits on the electrodes and the conductivity of the water. During operation the water level must be gradually increased to compensate for the loss of effective electrode area from the mineral deposits.

With initial water levels in the tank substantially below about $\frac{1}{3}$ the electrode height, minerals tend to rapidly deposit on the immersed portion of the electrodes and these deposits build up to the point where a blockage is created in the bottom of the tank, preventing the inflow and/or drainage of water. This can occur with considerable unused electrode surface above the water level which means that the effective life of the steam generator is shorter than possible. Also, the electrodes can become completely uncovered from time to time during the drain cycle. This can adversely affect the electrical control system which operates on the basis of the amount of electrode immersion.

With initial water levels over about $\frac{1}{2}$ of the electrode height, the increasing water level required to compensate for mineral deposits during operation reaches a point where the volume above the water level is insufficient to produce the required steam within a shorter than optimum time period. Thus, it is desirable for the electrodes to be designed so they can produce the desired amount of steam at a given electrode voltage with about $\frac{1}{3}$ of their height immersed in water at startup.

The current passing through the electrodes varies as the circumferential spacing or horizontal distance between the electrode varies. Accordingly, the electrode mounting arrangement desirably should be arranged to permit convenient adjustment of the horizontal distance between electrodes when required to compensate for the conductivity of the particular water to be used. Adjustable electrode mounting arrangements are known; however, they are not designed to insure that adjacent electrodes are maintained in parallel relationship and uniformly spaced when adjustments in the horizontal distance are made.

U.S. Pat. No. 3,761,679 discloses the use of tapered electrodes having a complex geometric shape such that, as the water level increases, the surface of the electrodes covered by water increases geometrically and the horizontal distance between the electrodes decreases. With such an arrangement, the effect of differences between the conductivity of water is offset by relatively small increases in the water level which produces a substantial increase in the current flow due to the combined effect of the increased electrode area and the decreased horizontal distance between the electrodes and a proportional increase in the amount of steam generated. However, there is no provision for adjusting the horizontal distance between the electrodes as may be required for certain water conductivities in order to permit start up with an optimum initial wafer fill as discussed above.

SUMMARY OF THE INVENTION

One of the principal objects of the invention is to provide an electrical steam generator for an air humidifier including means for mounting the electrodes which affords convenient adjustment of horizontal distance between adjacent electrodes in a manner whereby the sides of the electrodes are maintained parallel to each other and uniformly spaced.

Another of the principal objects of the invention is to provide an electrical generator for an air humidifier including electrodes which are arranged to give reliable control from start up through the effective life of the electrodes.

A further of the principal objects of the invention is to provide an electrical generator for an air humidifier including electrodes which are arranged to permit higher initial water levels without reducing their overall effective life and to prevent rapid bridging of mineral deposit between the electrodes and the tank side wall.

Other objects, aspects and advantages of the invention will become apparent to those skilled in the art upon reviewing the following description, drawings and the appended claims.

The invention provides an electrical steam generator for an air humidifier including a generally cylindrical water tank including a top wall having a steam outlet, a bottom wall having a water inlet, and a generally vertical side wall, a plurality of circumferentially-spaced electrical terminals extending through the tank top wall at substantially equal intervals, and a plurality of electrodes having a pair of vertically extending, generally flat side members which diverge from each other in a direction toward the tank side wall and terminate in an outer edge spaced radially inwardly from the tank side wall. Each electrod is electrically connected to an electrical terminal and anchored to the underside of the tank top wall in uniformly spaced relationship in a manner whereby the side members of adjacent electrodes are generally parallel and the circumferential spacing between the side members of adjacent electrodes can be adjusted by movement of each electrode along a radial line to thereby maintain the side members of adjacent electrodes in a generally parallel relationship.

Such an adjustment capability can be accomplished by providing, a radially-extending row of radially-spaced internal bosses on the underside of the tank top wall in conjunction with each of the terminals. Each of the internal bosses has an aperture radially aligned with the corresponding terminal and is adapted to receive means for anchoring the upper end of an electrode to the underside of the tank top wall. The upper end portion of each electrode is provided with a row of apertures which are adapted to receive a terminal and are spaced relative to the apertures in the tank bosses such that, when a terminal is positioned in any one of the electrodes apertures, at least one other of the electrode apertures is in registration with a tank boss aperture. The upper end of each of the electrodes is fastened to a terminal by a nut or the like threaded onto the inner end of the electrode projecting from the tank top wall and the upper end portion of each electrode is anchored to the underside of the tank top wall by a fastener located in an electrode aperture and a tank boss aperture which are in registration.

The invention also provides electrodes for a steam generator having the above general configuration, each of the electrode side members including an upper portion having a vertical outer edge which extends generally parallel to the tank side wall and a lower portion having an outer edge which extends at an incline downwardly and radially inwardly from the outer edge of the upper portion.

DESCRIPTION OF THE PREFERRED EMBODIMENTS

Figure 1:
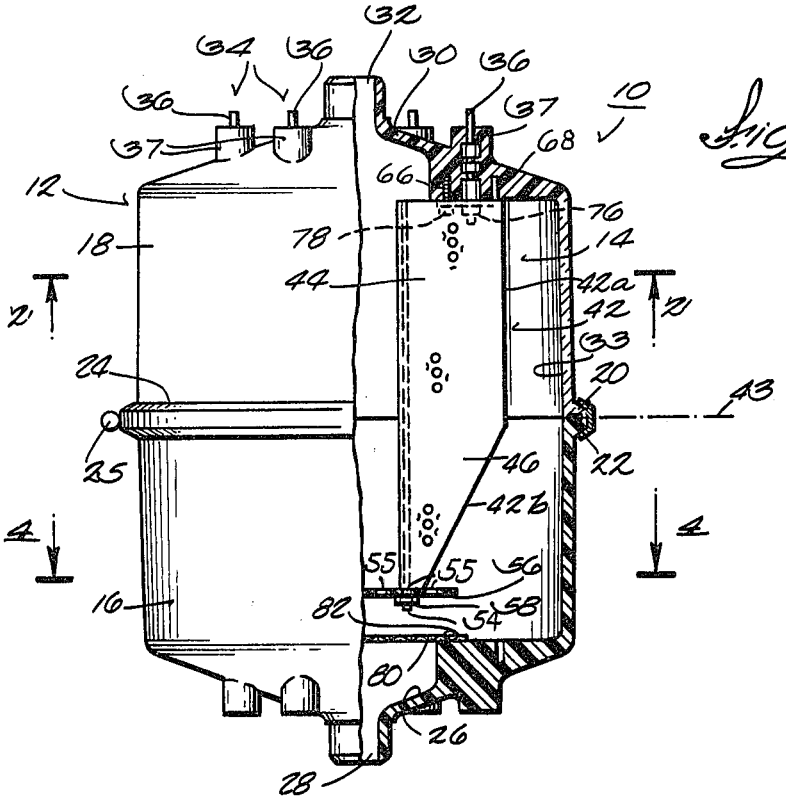
FIG. 1 is a side elevation, partially broken away view of a steam generator for an air humidifier incorporating various features of the invention.

Illustrated in FIG. 1 is an electrically-operated boiler or steam generator 10 for an air humidifier. The steam generator 10 includes a generally cylindrical, upright tank 12 partially filled with water and a plurality (e.g. 6) of circumferentially-spaced electrodes 14 partially immersed in the water and connected to an electrical supply (not shown).

The tank 12 is composed of two cylindrical halves, a bottom half 16 and a top half 18, preferably molded from a transluscent synthetic plastic material, such as polypropylene, so that the water level can be observed through the tank walls. The cylinder halves 16 and 18 having mating flanges 20 and 22 which are held together with a U-shaped band clamp 24 including a threaded retainer 25. The bottom cylinder half 16 has a bottom wall 26 including a water inlet 28 through which water is introduced into and drained from the tank 12 in the usual manner during operation of the humidifier. The top cylinder half 18 has a top wall 30 including a steam outlet 32 through which a stream of steam is discharged and dispersed in the usual manner into the air distribution system (not shown) for a building or the like. The top and bottom cylinder halves 16 and 18 cooperatively form a vertical side wall 33.

Molded integrally in the top wall 30 of the top cylinder half 18 are a plurality (e.g., 6) of circumferentially-spaced electrical terminals 34 including an outer end 36 projecting externally from circular bosses 37 on the top of the tank 12 and a threaded inner end portion 38 projecting inwardly beyond the underside of the top wall 30.

Figure 5:
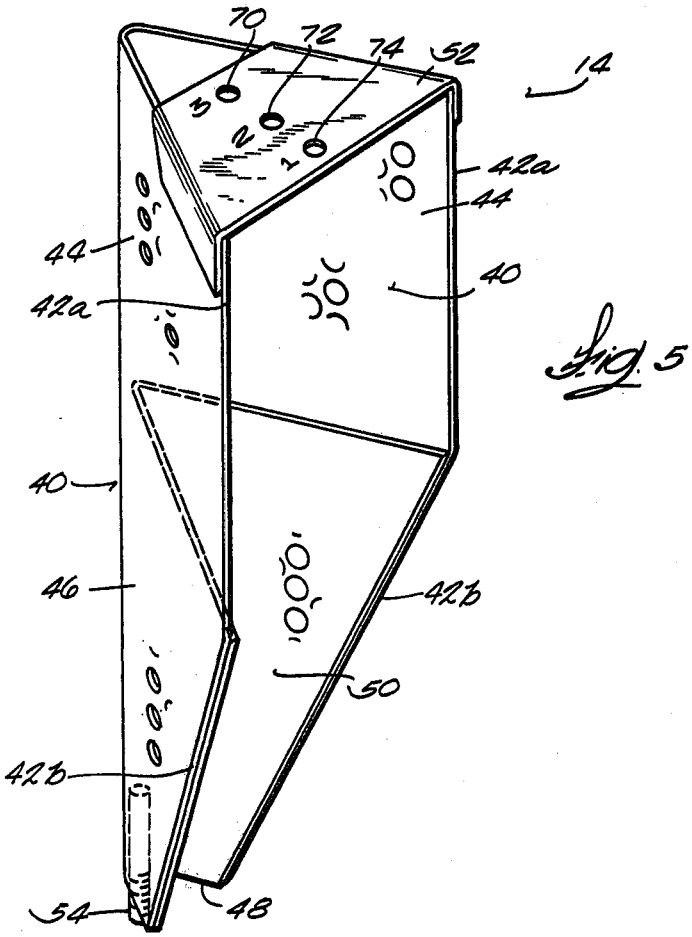
FIG. 5 is a perspective view of an electrode.
Figure 3:
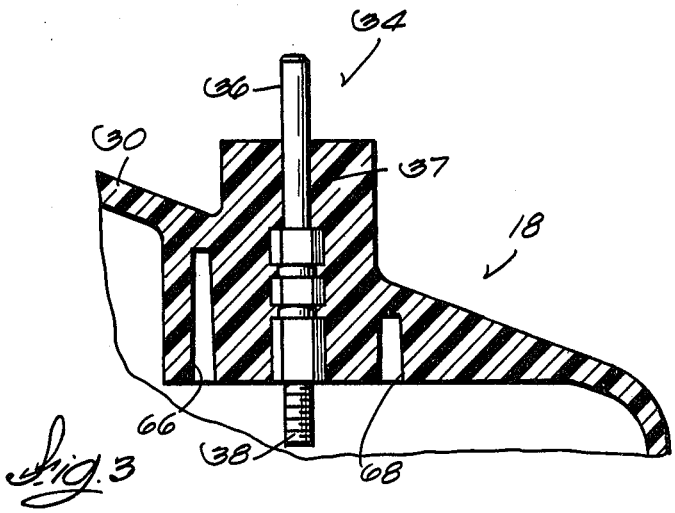
FIG. 3 is a fragmentary, sectional view taken generally along line 3—3 in FIG. 2.

As best shown in FIG. 5, each of the electrodes 14 includes a pair of vertically extending, generally flat, elongated side members 40 which are perforated and are connected together in angular relationship along an inner edge to form a V-shaped cross section. The side members 40 diverge from each other in a radial direction toward the tank side wall 33 and terminate in an outer edge 42 spaced radially inwardly from the tank side wall 33.

Each side member 40 has a top or upper portion 44 including a substantially straight outer edge **42*a* which extends generally vertically and parallel to the tank side wall 33 and a bottom or lower portion 46 including an outer edge 42*b* which extends at an incline downwardly and radially inwardly from the outer edge 42*a* of the top portion 44 toward the central axis of the tank 12. While this incline can vary, it usually is in the order of about 45° relative to the tank axis. The juncture of the edges 42*a* and 42*b* usually is located approximately at the horizontal medial plane 43 of the tank 12**.

The bottom end of the electrodes 14 is blunt, i.e., terminates in a short horizontally-extending bottom edge 48, rather than being pointed in order to minimize a tendency of electrical arcing and corona discharge.

The electrodes 14 preferably are formed from a planar perforated plate which has the appropriate shape and is bent at the center to provide the desired V-shape. The lower portion 46 of the electrodes 14 preferably has a double thickness in order to minimize burnout from high density wattage when the water is at a level which covers only a relatively small portion of the electrode. This can be accomplished by welding to the lower portion 46 an auxiliary perforated plate 50 having a shape generally corresponding to the lower portion 46. The auxiliary plate 50 can be welded onto the main plate prior to either being bent or welded to the main plate after both have been bent.

A base plate 52 extending over the top edges of the electrode side members 40 and spot welded or otherwise affixed thereto provides rigidity and serves as a support for connecting an electrode 14 to an electrical terminal 34 and for anchoring an electrode 14 to the top wall 30 of the tank 12 as described in more detail below.

Affixed to the bottom end of each electrode 14 and depending therefrom is a threaded stud 54. The stud 54 fits through one of a plurality of apertures 55 in a horizontally extending, electrically insulative, perforated plate member or disc 56. The disc 56 is fastened to the electrodes 14 by nuts 58 threaded onto the studs 54 and serves to stabilize the bottom ends of the electrodes 14. The apertures 55 are radially spaced at equal intervals in radially extending rows to accommodate radial adjustment of the electrodes 14 as described in more detail below.

Means are provided for electrically connecting each electrode 14 to an electrical terminal 34 and for anchoring the electrodes on the top wall 30 so that the side members 40 of adjacent electrodes 14 are located in uniformly-spaced, parallel relationship and are maintained in the parallel relationship when the horizontal distance or circumferential spacing between electrodes is adjusted to compensate for changes in the water conductivity under extreme conditions. In the specific construction illustrated, this is accomplished by providing a row 60 (FIG. 2) of circular bosses 62 and 64 on the underside of the top wall 30 of the top cylinder half 18 in conjunction and radially aligned with each electrical terminal 34. The bosses 62 and 64 respecively include central apertures 66 and 68 which are radially spaced at equal intervals from the opposite sides of an electrical terminal 34 and are adapted to receive a sheet metal screw or the like.

Figure 2:
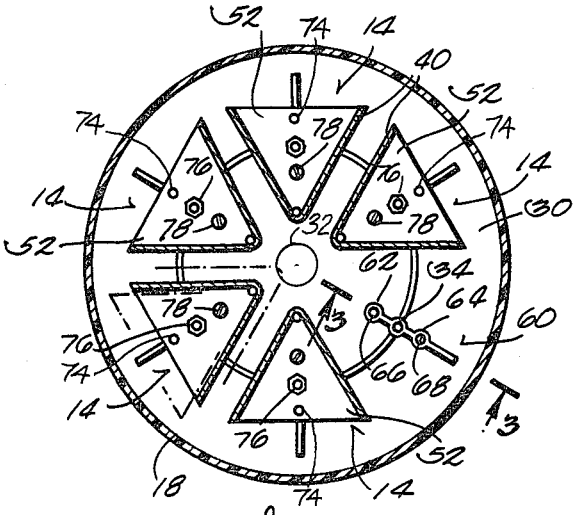
FIG. 2 is a sectional view taken generally along line 2—2 in FIG. 1, shown with one electrode removed.
Figure 4:
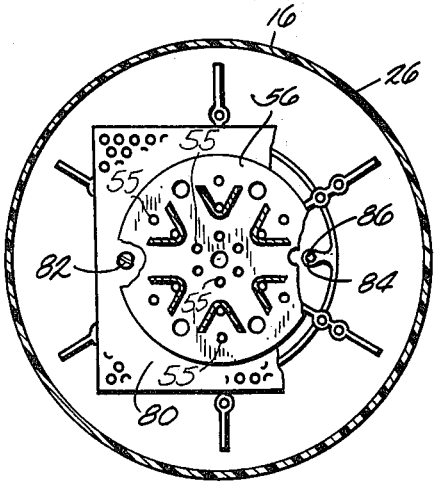
FIG. 4 is a sectional view, partially broken away, taken generally along line 4—4 in FIG. 1.

The electrode base plate 52 (FIG. 5) is provided with a radially extending row of apertures 70, 72 and 74 which are adapted to receive the inner end portion 38 of an electrical terminal 34 and are radially spaced at equal intervals so that, when an electrical terminal 34 is positioned in one of the apertures 70, 72 and 74, at least one other of these apertures is in registration with boss apertures 62 or 64. As shown in FIG. 2, the electrical terminals 34 are positioned in the base plate apertures 72 and the base plate apertures 70 are in registration with the boss apertures 66.

The electrodes 14 are electrically connected to the electrical terminals 34 by a nut 76 which is threaded onto the inner end portion 38 projecting through the base plate aperture 72. The electrodes 14 are anchored onto the top wall 30 by a sheet metal screw 78 extending through the base plate aperture 70 and tapped into the boss aperture 66.

The horizontal distance between the electrodes 14 can be adjusted to compensate for extreme water conditions by removing the nut 76 and the screw 78, positioning the electrical terminal 34 in the appropriate base plate aperture, threading the nut 76 back onto the inner end portion 38 of the electrical terminal 34 and screwing the metal screw 78 into the boss aperture in registration with the base plate aperture. Since the boss apertures extend in a row radially aligned with the electrical terminals and the base plate apertures are also radially aligned, the electrodes 34 are moved along a radial line and the side members 40 of adjacent electrodes are maintained in parallel relationship during the adjustment as shown by the dashed line in FIG. 2.

The base plate apertures 70, 72 and 74 are identified by indicia on the base plate 52 such as by numerals 1, 2 and 3. This indicia serves as reference for insuring that all the electrodes are mounted at the same position, and therefore uniformly spaced, during initial assembly or subsequent adjustment.

A screen 80 covering the water inlet 28 is fastened to the bottom wall 26 of the cylinder half 16 by sheet metal screws 82 tapped into apertures 84 in circular bosses 86 provided on the bottom wall 26. The screen 80 serves as a strainer for preventing particulate contaminants from passing out of the tank 12 during the drain cycle.

During operation, the tank 12 is initially filled to a level which provides the necessary electrode coverage to obtain the current draw required at a given voltage to produce the desired amount of steam. Since the lower portions 46 of the electrode side members 40 are inclined or tapered, the water level initially must be somewhat higher than that would be the case for straight-sided electrodes in order to obtain coverage of the same surface area. This higher water level minimizes the chances of the electrodes becoming completely uncovered during the drain cycle when higher conductive water is being used as discussed above. The increased distance between the tapered lower portions of the electrode side members and the tank side wall 33 increases the time period for mineral deposits to form a bridge between electrodes 14 and the tank side wall 33 and thereby block or impede the flow of water into and out of the tank.

With the tapered lower portions 46, the electrodes 14 can accommodate a wider range of water conductivities even though a higher initial water level is used. That is, the amount of electrode surface area covered, and thus the current flow, increases geometrically as the water level rises instead of directly proportional as is the case with straight-sided electrodes. For example, with an electrode having a 45° taper, the current draw would be two times that of a straight-sided electrode for the same increase in water level. After the initial fill, the current draw for a given voltage can be increased to compensate for mineral deposits and/or changes in water conductivity with smaller increases in the water level, thereby minimizing the chances of the water level rising to a point where there is insufficient volume above the water to generate the required amount of steam even though the electrodes have remaining effective life. Thus, the tapered electrodes, in addition to minimizing premature mineral deposit blockage, provide reliable control from start up throughout the effective life of the electrodes, particularly for higher conductive water.

At start up, the tank is usually filled with water to a level where approximately the lower $\frac{1}{3}$, but less than the lower $\frac{1}{2}$, of the electrodes 14 is covered in order to maximize the effective life of the electrodes and yet prevent them from becoming uncovered during the drain cycle.

From the foregoing description, one skilled in the art could easily ascertain the essential characteristics of the invention and, without departing from the spirit and scope thereof, make various changes and modifications to adapt it to various usages.

I claim:

1. An electrical steam generator for an air humidifier comprising a generally cylindrical, upright water tank including a top wall having a steam outlet, a bottom wall having a water inlet, and a generally vertical side wall;

a plurality of circumferentially-spaced electrical terminals extending through the top wall of said tank at substantially equal intervals and having an inner end projecting inwardly beyond the underside of said top wall a plurality of electrodes disposed inside said tank, said electrodes having a pair of vertically extending, elongated, generally flat side members which are connected together along an inner edge, which diverge from each other in a direction toward the side wall of said tank and which terminate in an outer edge spaced radially inwardly from the side wall of said tank;

a radially-extending row of radially-spaced internal bosses on the underside of said top wall in conjunction with each of said terminals, each of said internal bosses having a first aperture adapted to receive means for anchoring the upper end of a said electrode to the underside of the top wall of said tank;

a radially-extending row of second apertures in the upper end portion of each of said electrodes, said second apertures being adapted to receive a terminal and being spaced relative to said first apertures such that, when a terminal is positioned in any one of said second apertures, at least one other of said second apertures is in registration with a said first aperture;

means for fastening the upper end of said electrode to the inner end portion of said terminals; and means for anchoring the upper end portion of said electrode to the underside of the top wall of said tank via said first and second apertures which are in registration.

2. An electrical steam generator according to claim 1 wherein each of said electrode side members include an upper portion having a generally vertical outer edge which extends generally parallel to the side wall of said tank; and a lower portion having an outer edge which extends at an incline downwardly and radially inwardly from the outer edge of said upper portion.

3. An electrical steam generator according to claim 2 wherein the juncture of the outer edge of said upper and lower portions is located approximately at the horizontal medial plane of said tank.

4. An electrical steam generator according to claim 1 wherein said lower portion of said electrode terminates at the bottom in a horizontally-extending edge.

5. An electrical steam generator according to claim 1 wherein said electrodes have a lowermost end spaced above the bottom wall of said tank; and said steam generator further includes a horizontally extending plate member, and means for anchoring the lowermost end of said electrodes to said plate member.

6. An electrical steam generator for an air humidifier comprising a generally cylindrical, upright water tank including a top wall having a steam outlet, a bottom wall having a water inlet, and a generally vertical side wall;

a plurality of circumferentially-spaced electrical terminals extending through the top wall of said tank at substantially equal intervals; and a plurality of electrodes disposed inside said tank with each connected to a said terminal, each of said electrodes having a pair of vertically-extending, elongated, generally flat side members which are connected together along an inner edge, which diverge from each other in a direction toward the side wall of said tank and which terminate in an outer edge radially spaced from the side wall of said tank; and each of said electrodes side members including an upper portion having a vertical outer edge which extends generally parallel to the side wall of said tank and a lower portion having an outer edge which extends at an incline downwardly and radially inwardly from the outer edge of said upper portion and which terminates at the bottom in a generally horizontally extending edge, the side members of adjacent electrode being in generally parallel relationship substantially along their entire height.

7. A steam generator according to claim 6 wherein the juncture of the outer edges of said upper and lower portions of said electrodes is located approximately at the horizontal media point of said tank.

8. A steam generator according to claim 6 wherein said lower portion of said electrodes is substantially thicker than said upper portion of said electrodes.

9. A steam generator according to claim 6 including a horizontally extending, electrically insulative plate member, and means for anchoring said plate member on the lower ends of said electrodes.

* * * * *

UNITED STATES PATENT AND TRADEMARK OFFICE

CERTIFICATE OF CORRECTION

PATENT NO. : 4,423,310

DATED : December 27, 1983

INVENTOR(S) : Allen J. Zerbel

It is certified that error appears in the above—identified patent and that said Letters Patent is hereby corrected as shown below:

Column 8, line 29 "media" should be --medial--.

Signed and Sealed this

Tenth Day of April 1984

[SEAL]

*Attest:*

GERALD J. MOSSINGHOFF

*Attesting Officer*

*Commissioner of Patents and Trademarks*